US006374600B2

(12) United States Patent
Uegane et al.

(10) Patent No.: US 6,374,600 B2
(45) Date of Patent: Apr. 23, 2002

(54) VEHICLE ENGINE EXHAUST SYSTEM

(75) Inventors: Masayuki Uegane; Hidenori Suzuki, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/841,251

(22) Filed: Apr. 25, 2001

(30) Foreign Application Priority Data

Apr. 26, 2000 (JP) ..... 2000-125326

(51) Int. Cl.[7] ..... F01N 7/00
(52) U.S. Cl. ..... 60/322; 60/323
(58) Field of Search ..... 60/322, 323; 180/309, 180/296; 280/782

(56) References Cited

U.S. PATENT DOCUMENTS

| | | | | |
|---|---|---|---|---|
| 4,860,538 A | | 8/1989 | Takeuchi | 60/313 |
| 5,127,489 A | * | 7/1992 | Takato et al. | 180/309 |
| 5,144,800 A | * | 9/1992 | Shioya et al. | 60/323 |
| 5,195,607 A | * | 3/1993 | Shimada et al. | 60/323 |
| 5,239,826 A | * | 8/1993 | Hirota et al. | 60/302 |
| 5,438,830 A | | 8/1995 | Matsumura | 60/302 |
| 5,568,726 A | * | 10/1996 | Yamada et al. | 60/323 |
| 5,956,949 A | * | 9/1999 | Mayer et al. | 60/323 |
| 6,182,446 B1 | * | 2/2001 | Gunther et al. | 60/302 |
| 6,182,447 B1 | * | 2/2001 | Hashimura et al. | 60/323 |

FOREIGN PATENT DOCUMENTS

| | | | |
|---|---|---|---|
| JP | 62-67921 | 4/1987 | F01N/7/08 |
| JP | 404350321 | * 12/1992 | |

OTHER PUBLICATIONS

Japanese Abstract No. 60050215, dated Mar. 19, 1985.
Japanese Abstract No. 58015710, dated Jan. 29, 1983.

* cited by examiner

*Primary Examiner*—Thomas Denion
*Assistant Examiner*—Diem Tran
(74) *Attorney, Agent, or Firm*—Sughrue Mion, PLLC

(57) ABSTRACT

In a vehicle exhaust system, downstream end portions of front and rear exhaust pipes Ef, Er which respectively connect to front and rear cylinder banks are arranged side by side with each other in the same direction so as to be connected to a common collecting exhaust pipe 22, so that exhaust gases flowing through the front and rear exhaust pipes Ef, Er are allowed to flow into the common collecting exhaust pipe 22 in the same direction. Mating faces **15*f*, 20*f* are respectively formed on the end portions of the front and rear exhaust pipes Ef, Er which are located closer to the collecting portion, and the mating faces 15*f*, 20*f*** are confronted from each other. The mating faces are inclined relative to a plane (P-P) passing through centers Ca, Cb of the front and rear exhaust pipes Ef, Er.

8 Claims, 7 Drawing Sheets

VEHICLE ENGINE EXHAUST SYSTEM

BACKGROUND OF THE INVENTION

The present invention relates to a vehicle, or, mainly, automotive engine exhaust system in which a pair of front and rear cylinder banks of an engine, a crank shaft of which extends in a transverse direction of a vehicle body, are disposed in a longitudinal direction of the vehicle body, and in which a front exhaust pipe and a rear exhaust pipe which connect, respectively, to exhaust ports of the front cylinder bank and exhaust ports of the rear cylinder bank via exhaust manifolds are connected to a common collecting exhaust pipe at a collecting portion below the engine.

Conventionally, in an exhaust system for a so-called transverse V-type or horizontal opposed engine in which two front and rear cylinder banks are disposed in a longitudinal direction of a vehicle body with a crankshaft being disposed to extend transversely, a vehicle engine exhaust system is known in which a front exhaust pipe and a rear exhaust pipe which connect, respectively, to the front cylinder bank and the rear cylinder bank via exhaust manifolds are connected to a common collecting exhaust pipe at a collecting portion below the engine (for example, Japanese Utility Model Unexamined Publication Sho. 62-67921).

With the conventional vehicle exhaust system, however, the front exhaust pipe connected to the front cylinder bank is caused to extend toward the collecting portion below the engine from ahead of the engine, while the rear exhaust pipe connected to the rear cylinder bank is caused to extend toward the collecting portion below the engine from rearward of the engine, and the front and rear exhaust pipes are combined at substantially right angles at the collecting portion. This caused a problem that avoiding an interference of exhaust gas flows from the two exhaust pipes at the collecting portion is not possible, and as a result, interference noise of the exhaust gas flows is generated to constitute a cause of vehicle noise. Additionally, there was caused a problem that the interference of exhaust gas flows increases the exhaust resistance, which then reduces the exhaust gas flow rate, causing reduction in engine output.

SUMMARY OF THE INVENTION

The invention was made in view of the aforesaid situations, and a principal object thereof is to provide a novel vehicle engine exhaust system which can solve the aforesaid problems by improving the front and rear exhaust pipes, the common collecting exhaust pipe and the connecting portion of these exhaust pipes.

With a view to attaining the object, according to a first aspect of the invention, there is provided a vehicle engine exhaust system in which a pair of front and rear cylinder banks of an engine, a crank shaft of which extends in a transverse direction of a vehicle body, are disposed in a longitudinal direction of a vehicle body, and in which a front exhaust pipe and a rear exhaust pipe which connect, respectively, to exhaust ports of the front cylinder bank and exhaust ports of the rear cylinder bank via exhaust manifolds are connected to a common collecting exhaust pipe at a collecting portion below said engine. In the exhaust system, end portions on the collecting portion side of the front exhaust pipe and the rear exhaust pipe are arranged side by side in the same direction so as to be connected to the common collecting exhaust pipe, whereby exhaust gases flowing through the front and rear exhaust pipes are allowed to flow into the common collecting exhaust pipe in the same direction. According to the feature of the first aspect of the invention, it is possible to combine the exhaust gas flows from both the exhaust pipes at the collecting portion so as to flow in the same direction, whereby when compared with the conventional exhaust system, the interference of the exhaust gas flows can be reduced remarkably, thereby making it possible to solve the problems of generation of interference noise by the interference of the exhaust gas flows and reduction in the engine output.

In addition to above, in the first aspect of the present invention, the front exhaust pipe and the rear exhaust pipe are caused to extend downwardly from the exhaust manifolds, respectively, wherein the front exhaust pipe and the rear exhaust pipe are routed to below the engine by flexing the front exhaust pipe rearward of the engine and the rear exhaust pipe forward of the engine, whereafter either or both of the front exhaust pipe and the rear exhaust pipe are flexed again so that the ends on the collecting portion side of the two exhaust pipes are arranged side by side in the same direction so as to be connected to the common collecting exhaust pipe, and wherein mating faces which confront each other are formed, respectively, on sides of the front and rear exhaust pipes which are adjacent to each other, the mating faces being inclined relative to a plane passing through centers of the two front and rear exhaust pipes.

According to the first aspect of the invention, it is possible to reduce the likelihood that the thermal expansion of the exhaust pipes acts along the mating faces of the exhaust pipes as a force for causing a deviation between the mating faces, thereby improving substantially the fastening force at the collecting portion of the exhaust pipes and the strength of the constituent components at the collecting portion.

Furthermore, in the above-mentioned structure according to the present invention, it is preferable that the ends on the collecting portion side of the front exhaust pipe and the rear exhaust pipe are formed so as to have a cross section of a semi-circular shape, respectively, whereby flat face portions of the semi-circular end portions are made to function as the mating faces so that the end portions on the collecting portion side of the two exhaust pipes are arranged side by side in the same direction to thereby be connected to the common collecting exhaust pipe having a cross section of a circular shape, and wherein a ring member is provided upstream of a connecting portion between the end portions on the collecting portion side of the front and rear exhaust pipes and the common collecting exhaust pipe which is adapted to fit on an outer circumference of the end portions on the collecting portion side of the front and rear exhaust pipes so as to integrally hold the end portions on the collecting portion side.

According to the above-mentioned feature, it is possible to reduce the force acting on the connecting portion of the ends on the collecting portion side of the front and rear exhaust pipes with the common collecting exhaust pipe for causing a deviation between the front and rear exhaust pipes along the mating faces, as a result of which the strength and durability of the connecting portion can be improved.

Moreover, in the above-mentioned structure, it is further preferable that the outer circumference of the end portions on the collecting portion side of the two exhaust pipes and the ring member are welded together at portions of a fitting portion where the ring member fits on the front and rear exhaust pipes which do not intersect with extensions of the mating faces of the two exhaust pipes.

According to this structure, it is possible to alleviate the increase in stress at the ends of the front and rear exhaust pipes and ring member at the portion where the extensions of the mating faces of the two exhaust pipes and the ring member intersect with each other, whereby the reduction in strength and durability of the two exhaust pipes and the ring member can be suppressed minimally when the ring member and the outer circumference of the ends of the exhaust pipes are welded together.

The above-mentioned object can also be achieved by a vehicle engine exhaust system wherein a pair of front and rear cylinder banks of an engine a crank shaft of which extends in a transverse direction of a vehicle body are disposed in a longitudinal direction of the vehicle body. The vehicle engine exhaust system according to the present invention, comprises:

- a front exhaust pipe connected to a front exhaust port of the front cylinder bank via a front exhaust manifold;
- a rear exhaust pipe connected to a rear exhaust port of the rear cylinder bank via a rear exhaust manifold;
- a common collecting exhaust pipe connected to both of the front and rear exhaust pipes at a collecting portion substantially disposed below the engine; and
- a ring member integrally holding end portions of the front and rear exhaust pipes.

The end portions of the front and rear exhaust pipes which are located closer to the collecting portion are arranged side by side in the same direction so as to be connected to the common collecting exhaust pipe, whereby exhaust gases flowing through the front and rear exhaust pipes are allowed to flow into the common collecting exhaust pipe in the same direction. The end portions of the front and rear exhaust pipes which are located closer to the collecting portion are formed to have a cross section of a semi-circular shape respectively. The ring member is disposed upstream of the connecting portion defined by the end portions of the front and rear exhaust pipes and the common collecting exhaust pipe

DETAILED DESCRIPTION OF THE PREFERRED EMBODIMENTS

One preferred embodiment according to the present invention will be described hereinafter in the accompanying drawings.

The embodiment illustrates a case where the present invention is applied to an automotive engine exhaust system, and in the following description, terms such as "vertically," "transversely," and "longitudinally" are to be understood by reference to the advancing direction of an automotive vehicle.

Figure 1:
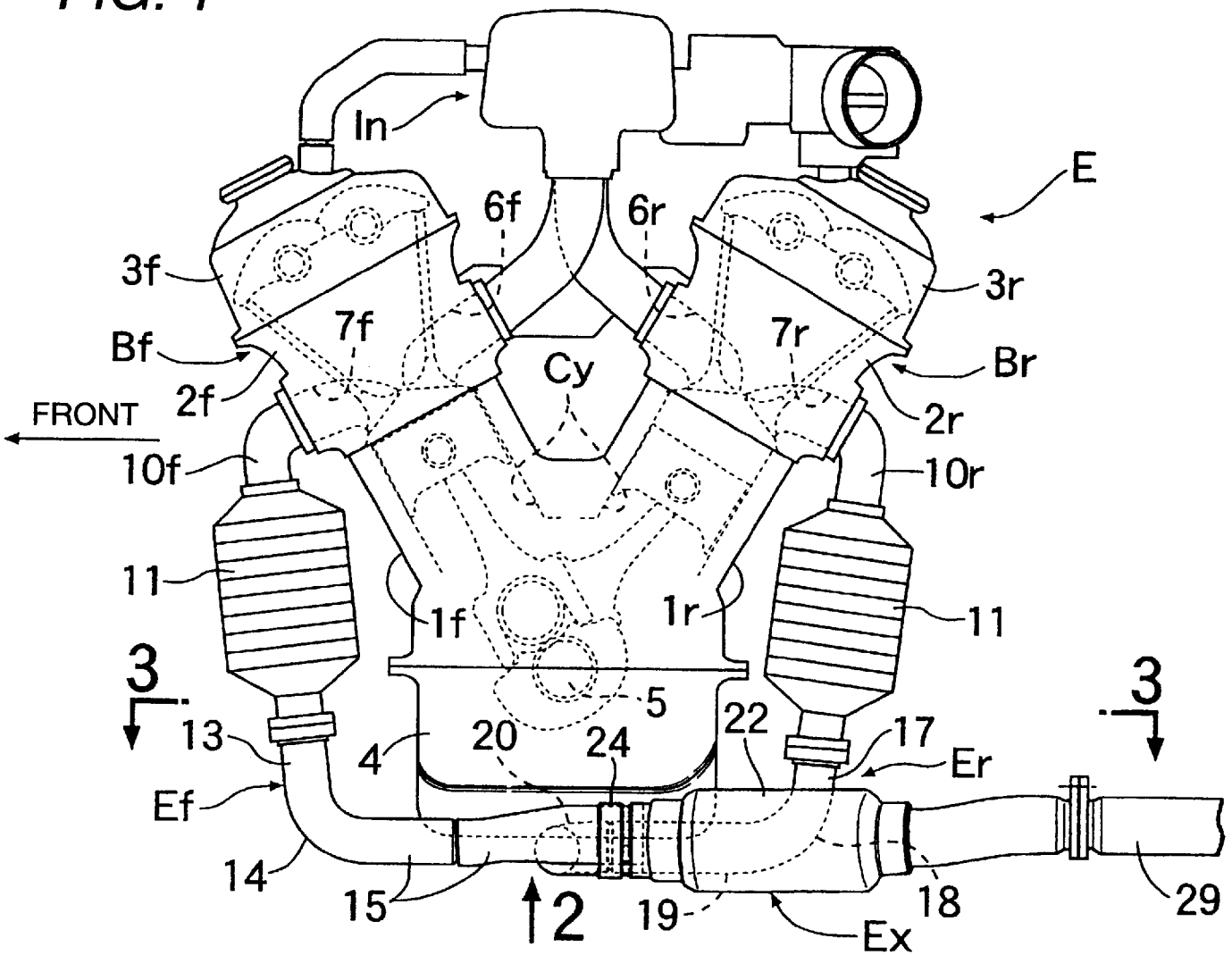
FIG. 1 shows side view of an engine equipped with an exhaust system.
Figure 2:
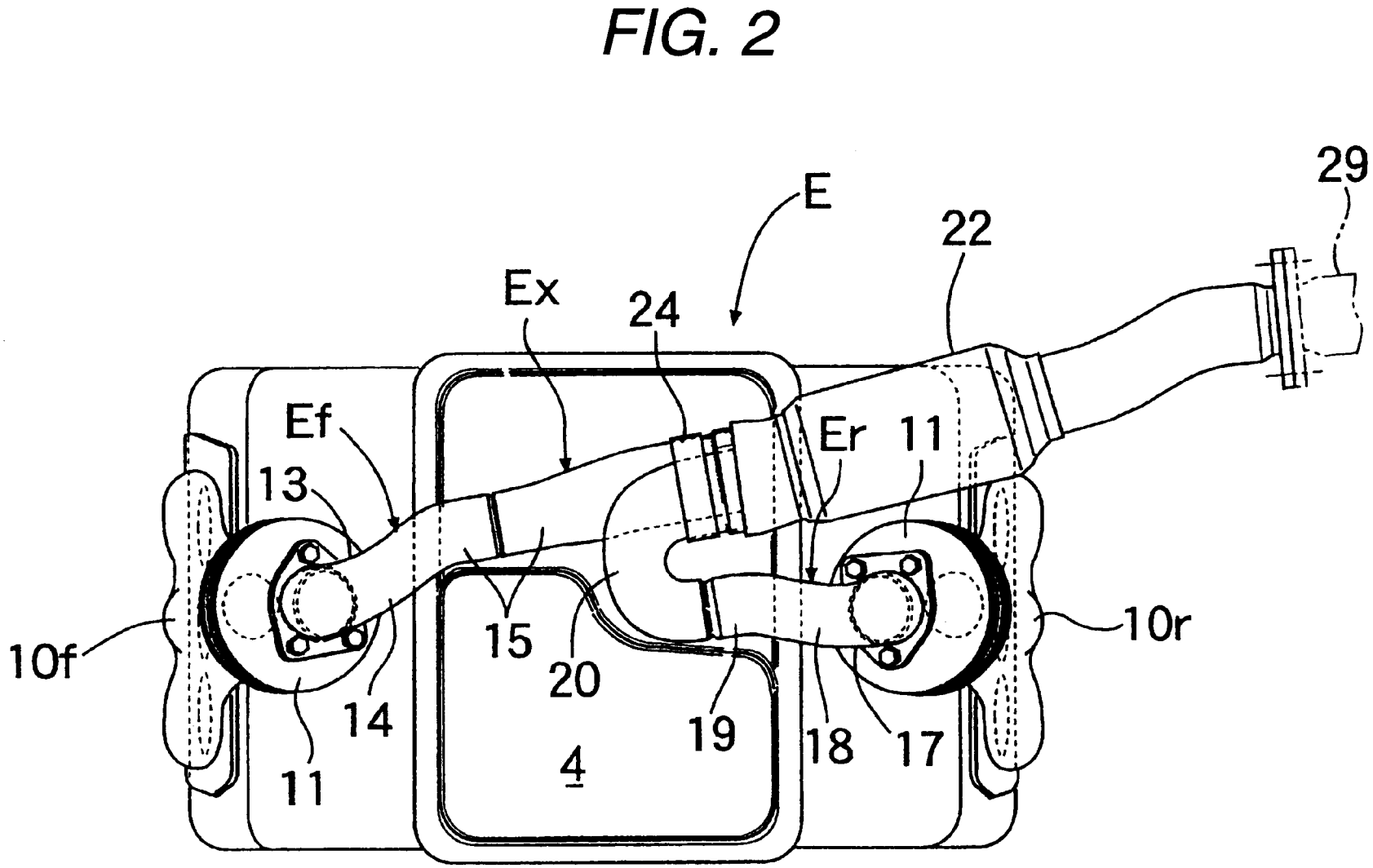
FIG. 2 shows a diagram as viewed in a direction indicated by an arrow of FIG. 1.
Figure 3:
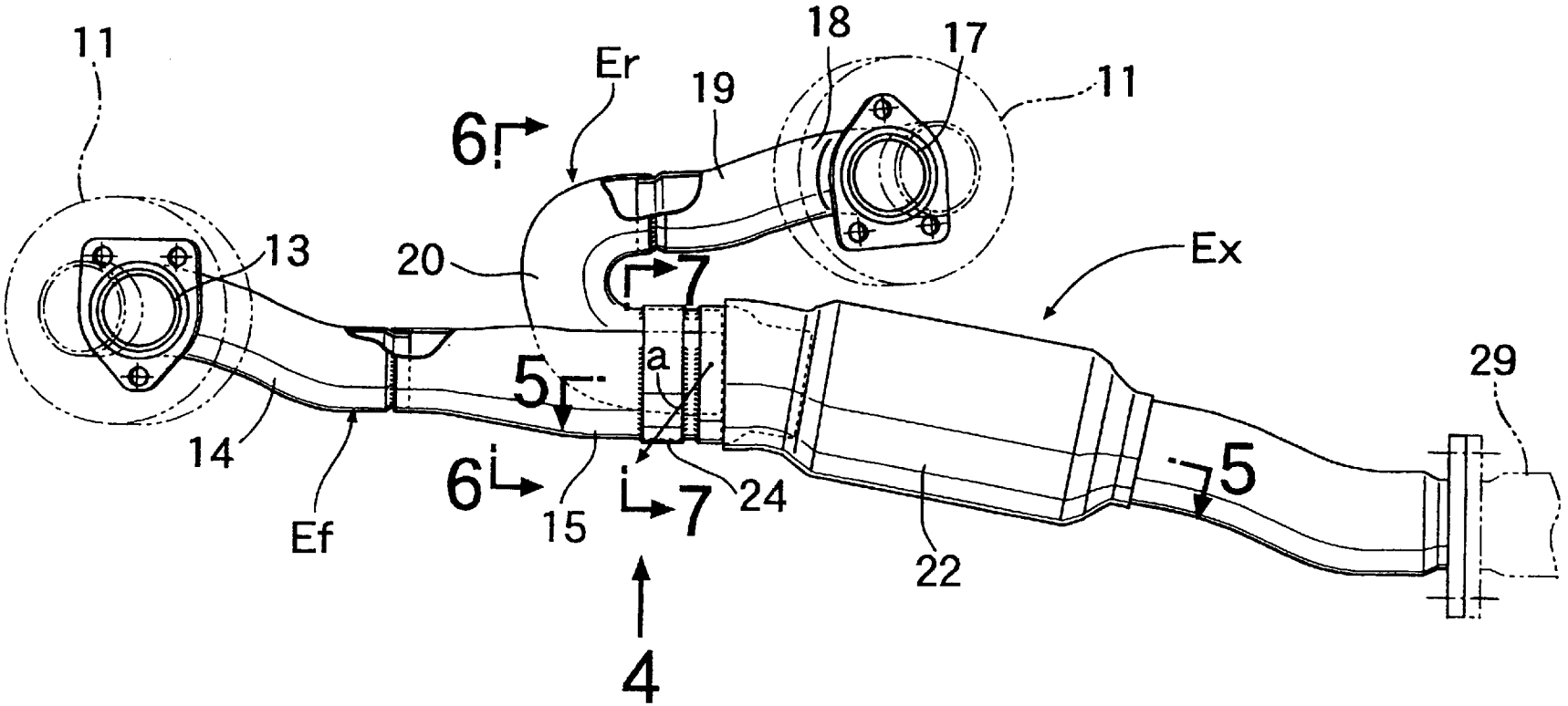
FIG. 3 shows a plan view of the exhaust system as viewed along the line.
Figure 4:
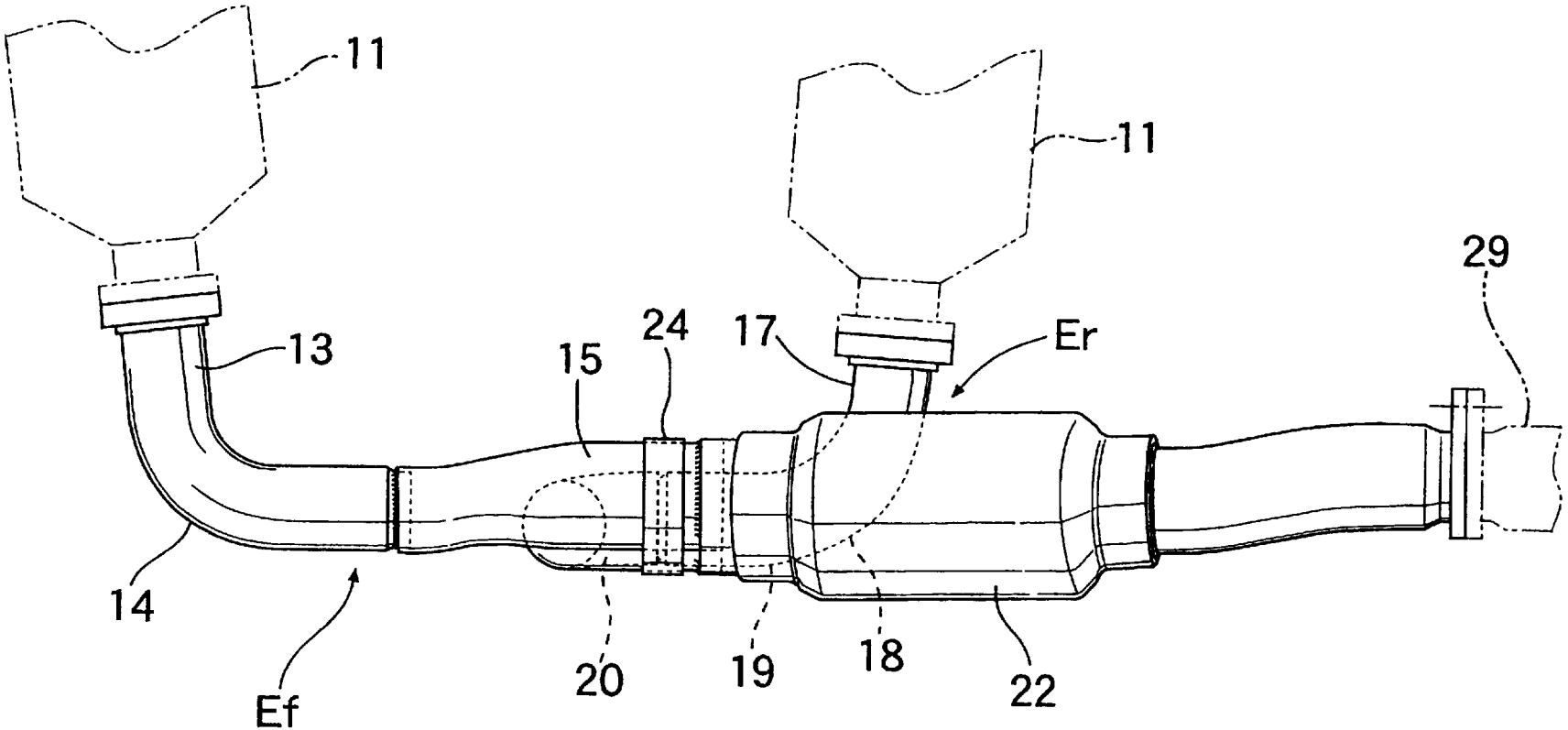
FIG. 4 is a diagram as viewed in a direction 4 indicated by an arrow 4 in FIG. 3.
Figure 5:
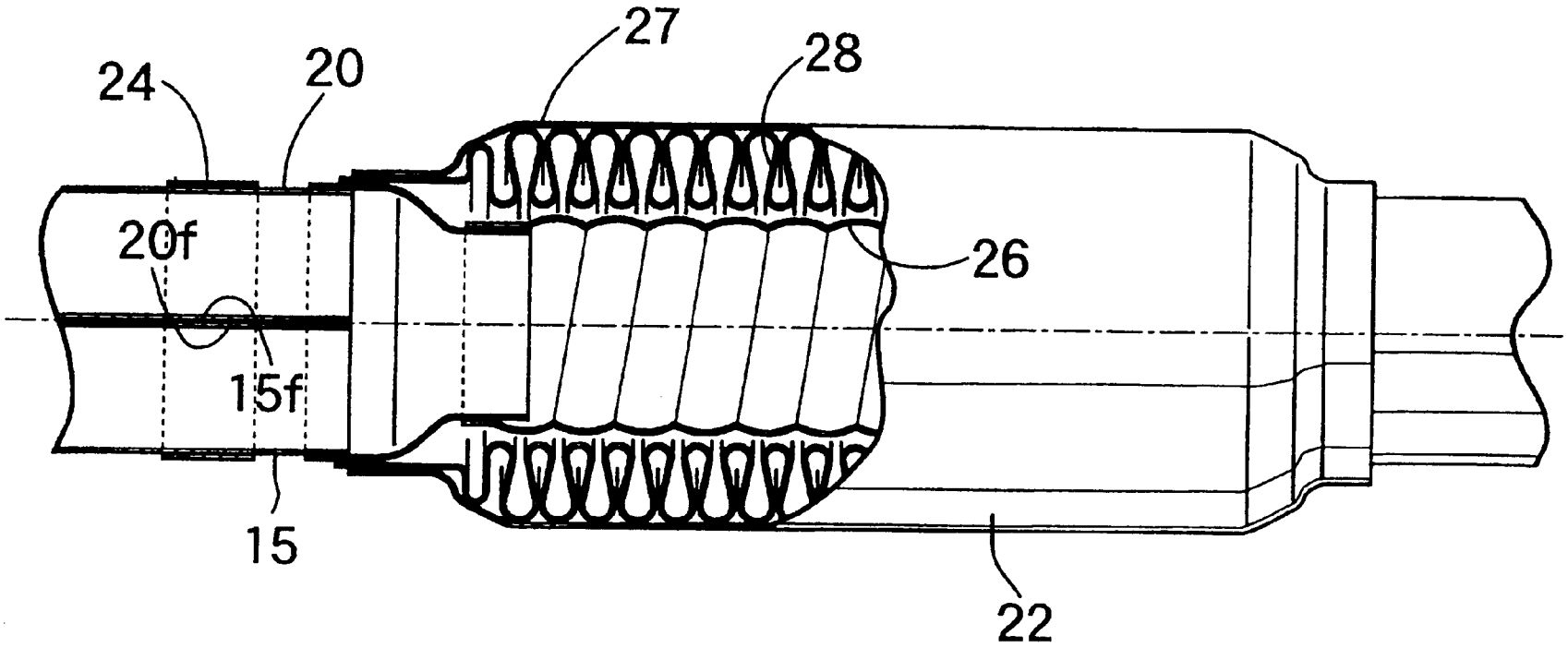
FIG. 5 shows an enlarged sectional view taken along the line 5—5 of FIG. 3.
Figure 6:
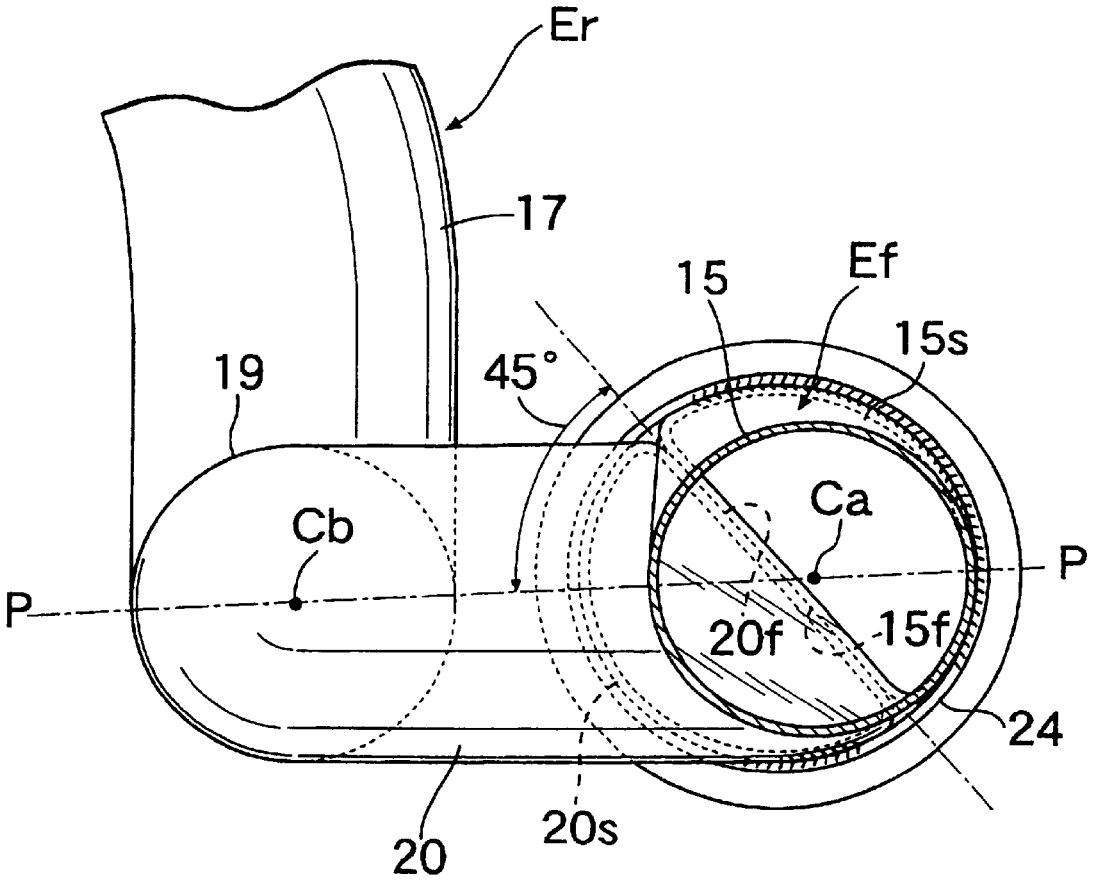
FIG. 6 shows an enlarged sectional view taken along the line 6—6 of FIG. 3.
Figure 7:
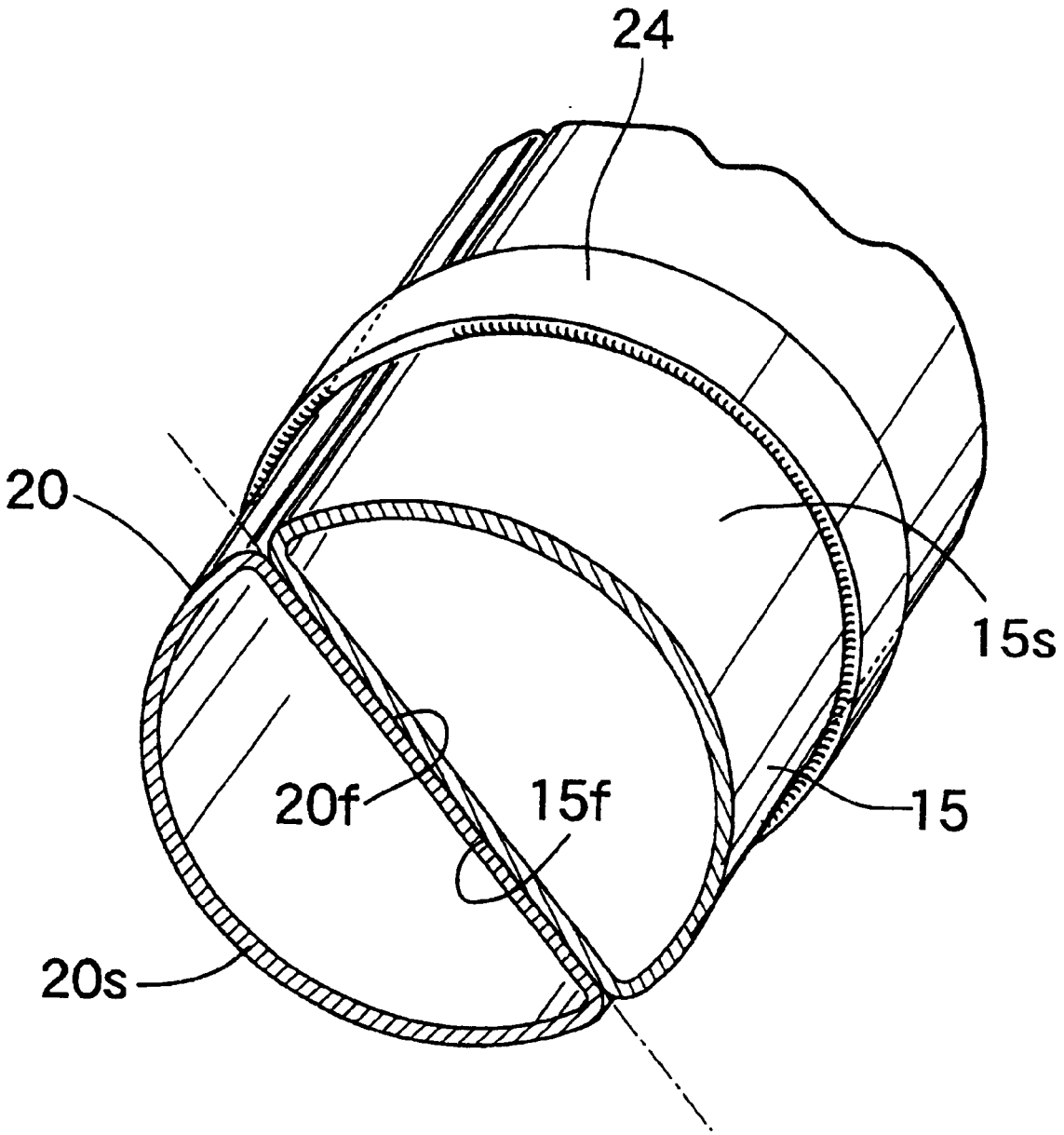
FIG. 7 shows an enlarged sectional view taken along the line 6—6 of FIG. 3.

This embodiment illustrates a case where an exhaust system according to the invention is fitted on a V-type multiple cylinder engine which is installed transversely (with a crankshaft being extended and disposed transversely of a vehicle body) in an automotive vehicle. FIG. 1 is a side view of an engine equipped with the exhaust system of the invention, FIG. 2 is a diagram as viewed in a direction indicated by an arrow 2 in FIG. 1, FIG. 3 is a plan view as viewed along the line 3—3 in FIG. 1, FIG. 4 is a diagram as viewed in a direction indicated by an arrow 4 in FIG. 3, FIG. 5 is an enlarged sectional view taken along the line 5—5 in FIG. 3, FIG. 6 is an enlarged sectional view taken along the line 6—6 in FIG. 3, and FIG. 7 is an enlarged view taken along the line 7—7 in FIG. 3.

In FIG. 1, an engine, the entirety of which is denoted by a reference character E, is a V-type multiple cylinder engine having a front cylinder bank Bf and a rear cylinder bank Br and is installed transversely (in a direction in which a crankshaft intersects with a longitudinal direction of the body of an automotive vehicle at right angles) in the body of the automotive vehicle. The front cylinder bank Bf is disposed at a longitudinal front of the transversely installed engine in such a manner as to be inclined forward, while the rear cylinder bank Br is disposed at a longitudinal rear of the transversely installed engine in such a manner as to be inclined rearward. This engine is formed into a V-shape when viewed from the side thereof.

The front cylinder bank Bf comprises a front cylinder block 1*f* having a plurality of cylinders Cy arranged therein in the transverse direction and a front cylinder head 2*f* adapted to be fixed onto a deck surface of the cylinder block, and an upper surface of the front cylinder head 2*f* is covered with a front head cover 3*f*. In addition, the rear cylinder bank Br comprises a rear cylinder block 1*r* having a plurality of cylinders Cy arranged therein in the transverse direction and a rear cylinder head 2*r* adapted to be fixed onto a deck surface of the cylinder block, and an upper surface of the rear cylinder head 2*r* is covered with a rear head cover 3*r*. Lower portions of the front cylinder block 1*f* and the rear cylinder block 1*r* are made integral with each other, and a common oil pan 4 is connected to an opened lower side of the integrated lower portion of the cylinder blocks. Then, a crankshaft 5 which extends along the transverse direction of the vehicle is supported rotatably on a connecting surface of the front and rear cylinder blocks 1*f*, 1*r* with the oil pan 4.

Front induction ports 6*f* and rear induction ports 6*r* are opened, respectively, in a rear face of the front cylinder head 2*f* and a front face of the rear cylinder head 2*r*, and an induction system In is connected to these induction ports 6*f*, 6*r* for supplying air-fuel mixture into the engine E. Thus, a conventional known induction system is adopted for this induction system In, and therefore, since the induction system is not a principal factor of the invention, the detailed description of the construction of the induction system will be omitted herein.

Front and rear exhaust ports 7*f*, 7*r* are opened in a front face of the front cylinder head 2*f* and a rear face of the rear cylinder head 2*r*, and an exhaust system Ex according to the invention is connected to these exhaust ports 7*f*, 7*r* for discharging exhaust gases produced by combustion of the engine to the outside of the engine.

Next, referring to FIGS. 2 to 7 as well as FIG. 1, the construction of the exhaust system Ex will be described in detail. A front exhaust manifold 10*f* having a close-coupled vertical catalyst 11 interposed therein is connected to the front face of the front cylinder head 2*f* of the front cylinder block Bf, and an upstream end of a front exhaust pipe Ef is connected to an exit of the front exhaust manifold 10*f* which is made to open downwardly. Additionally, a rear exhaust manifold 10*r* having a close-coupled vertical catalyst 11 interposed therein is connected to the rear face of the rear cylinder head 2*r* of the rear cylinder block Br, and an upstream end of a rear exhaust pipe Er is connected to an exit of the rear exhaust manifold 10*r* which is made to open downwardly.

The front exhaust pipe Ef is connected to the exit of the front exhaust manifold 10*f* in front of the engine and has a first portion 13 which is caused to extend downwardly from the connecting portion thereof with the front exhaust manifold 10*f* and a second portion 15 which is caused to extend rearward in the longitudinal direction below the engine E via an elbow-like curved portion 14 which downwardly follows the first portion 13. A latter-half of the second portion 15 is routed to below the engine E, and, as will be described in detail later, has a portion which is arranged side by side with a third portion 20 of the rear exhaust pipe Er, which portion is formed so as to have a cross section of a semi-circular shape. On the other hand, the rear exhaust pipe Er is connected to the exit of the rear exhaust manifold 10*r* behind the engine E and has a first portion 17 which is caused to extend downwardly from the connecting portion thereof with the rear exhaust manifold, a second portion 19 which is caused to extend forward in the longitudinal direction below the engine E via an elbow-like curved portion 18 which downwardly follows the first portion 13 and the third portion 20 which is flexed again (turned around) so as to extend rearward in the longitudinal direction, and this third portion has, as will be described in detail later, a portion which is routed to below the engine to be arranged side by side with the second portion 15 of the front exhaust pipe Ef and has a cross section of a semi-circular shape.

As is clearly shown in FIGS. 2, 3, the latter half of the second portion 15 of the front exhaust pipe Ef which extends rearward in the longitudinal direction and the third portion 20 of the rear exhaust pipe Er which extends rearward in the longitudinal direction are arranged side by side substantially in parallel with each other so as to extend in the longitudinal direction of the vehicle. Then, the latter half of the second portion 15 of the front exhaust pipe Ef and the third portion 20 of the rear exhaust pipe Er which are arranged side by side substantially in parallel with each other are formed, as shown in FIGS. 6, 7, so as to have a cross section of a semi-circular shape, and flat faces of those portions 15*s*, 20*s* each having the semi-circular cross section constitute mating faces 15*f*, 20*f* which contact each other. The mating faces 15*f*, 20*f* are, as shown in FIG. 6, inclined about 45 degrees relative to a plane P-P which passes through a center Ca of the second portion 15 of the front exhaust pipe Ef and a center Cb of the third portion 20 of the rear exhaust pipe Er. Thus, the inclination of the mating faces 15*f*, 20*f* is intended to reduce a "deviation" between the mating faces 15*f*, 20*f* which would be caused by thermal expansion of the front and rear exhaust pipes Ef, Er, which will be described in a latter part discussing the operation of the invention.

A downstream end of the front exhaust pipe Ef or a rear end of the second portion 15 of the front exhaust pipe Ef and a downstream end of the rear exhaust pipe Er or a rear end of the third portion 20 of the rear exhaust pipe Er collect at and are then integrally fitted in a front end of a common collecting exhaust pipe 22 which is caused to extend in the longitudinal direction below the engine E for connection thereto.

A ring member 24 is fitted on and then welded for fixation to an outer circumference of end portions on a collecting portion side of the front exhaust pipe Ef and the rear exhaust pipe Er upstream of a connecting portion of the end portions on the mating and collecting portion side of the two exhaust pipes with the common collecting exhaust pipe 22, so that the ring member 24 integrally holds the collecting portion side of the two exhaust pipes.

As is clearly shown in FIG. 7, in a case where the ring member 24 which is fitted on the outer circumference of the end portions on the mating and collecting portion side of the front exhaust pipe Ef and the rear exhaust pipe Er is fixed to the outer circumference of the end portions by welding, the end portions on the collecting portion side of the two exhaust pipes Ef, Er and the ring member 24 are fixed to each other by welding at portions of the ring member 24 which do not intersect with the extensions of the mating faces 15*f*, 20*f* of the end portions on the collecting portion side of the two exhaust pipes Ef, Er, whereby as will be described in detail later, it is possible to alleviate the increase in stress at the end portions on the collecting portion side of the two exhaust pipes Ef, Er and the ring member 24 at the portion where the extensions of the mating faces 15*f*, 20*f* and the ring member 24 intersect with each other, thereby making it possible to suppress the reduction in strength and durability of the two exhaust pipes Ef, Er and the ring member 24.

The common collecting pipe 22 is constituted by a flexible tube and comprises, as shown in FIG. 5, an inner 26 constituted by a flexible pipe, an outer 27 similarly constituted by a flexible net plate and a bellows-like extensible flexible tube 28 provided in an annular space portion between the inner and outer.

Furthermore, a downstream end of the common collecting exhaust pipe 22 is connected to an upstream end of another downstream side exhaust pipe 29, a downstream end of which is caused to open to the atmosphere via a catalyst provided under a floor of the vehicle, a muffler and the like.

Next, the operation of the embodiment will be described.

When the engine E is run, exhaust gases generated by combustion of fuel flow from the exhaust ports 7*f*, 7*r* in the front and rear cylinder banks 10*f*, 10*r* to the front and rear exhaust manifolds 10*f*, 10*r* and is primarily purified by the close-coupled vertical catalysts 11, 11. Then, the exhaust gases so purified pass through the front and rear exhaust pipes Ef, Er to get confluent in the common collecting exhaust pipe 22 and are secondarily purified and muffled while passing through the underfloor catalyst and the muffler to be finally discharged to the atmosphere.

Since the downstream ends on the collecting portion side of the front exhaust pipe Ef and the rear exhaust pipe Er, that is, the downstream ends of the second portion 15 of the front exhaust pipe Ef and the third portion 20 of the rear exhaust pipe Er are arranged side by side with each other with the same orientation so as to collect in the common collecting exhaust pipe 22, exhaust gases flowing through the front and rear exhaust pipes Ef, Er get confluent in the single common collecting exhaust pipe 22 with the same orientation, whereby the interference of exhaust gas flows is remarkably reduced when compared with the conventional exhaust system, thereby making it possible to solve the problems of the generation of interference noise by the interference of exhaust gas flows and the reduction in output of the engine.

In addition, since the temperature of exhaust gases flowing within the front and rear exhaust pipes Ef, Er is extremely high, the front and rear exhaust pipes Ef, Er tend to be thermally expanded by the heat of exhaust gases.

However, where the front and rear exhaust pipes Ef, Er are arranged as described above, since directions in which the front and rear exhaust pipes Ef, Er are thermally expanded are different, the exhaust pipes Ef, Er tend to deviate at the collecting portion along the mating faces 15*f*, 20*f*.

Now, let's assume that the mating faces 15*f*, 20*f* are parallel with a plane P-P which passes through the centers Ca, Cb of the two exhaust pipes Ef, Er which are arranged side by side. The directions in which the respective exhaust pipes tend to deviate along the mating faces 15*f*, 20*f* by virtue of thermal expansion thereof are different from each other, but most of the thermal expansion of the respective exhaust pipes acts as a force for causing a deviation between the respective exhaust pipes along the mating faces 15*f*, 20*f*, and therefore, a strong fastening force for holding the two exhaust pipes integrally and a strong strength are required, respectively, for the collecting portion and the respective constituent components of the collecting portion.

As with this embodiment, however, with the mating faces 15*f*, 20*f* being inclined (at about 45 degrees) relative to the plane P-P which passes through the centers Ca, Cb of the two exhaust pipes which are arranged side by side, as shown in FIG. 6, with the thermal expansion (thermal expansion in a direction indicated by an arrow a in FIG. 3) of the exhaust pipe which is flexed again or the rear exhaust pipe Er, since a thermal expansion component in a direction which intersects with a direction toward the common collecting exhaust pipe 22 is great, part of the thermal expansion comes to act as a force for pressing its own exhaust pipe against the mating exhaust pipe via the mating faces 15*f*, 20*f*, as a result of which there will be no case where most of the thermal expansion acts as the force for causing a deviation between the exhaust pipes along the mating faces 15*f*, 20*f*. Thus, the fastening force at the collecting portion and the strength of the constituent components of the collecting portion can be improved substantially.

For example, in the event that the mating faces 15*f*, 20*f* are inclined 90 degrees relative to the plane P-P passing through the centers Ca, Cb of the two exhaust pipes which are arranged side by side, since most of the thermal expansion of the exhaust pipe which is flexed again (the rear exhaust pipe Er) comes to act as the force for pressing its own exhaust pipe against the mating exhaust pipe via the mating faces, it is possible to prevent most effectively the action of the thermal expansion to deviate the two exhaust pipes along the mating faces 15*f*, 20*f*.

The reason why specifically the inclination of 45 degrees is used in this embodiment instead of 90 degrees is because the flexure at the portion where the exhaust pipe is flexed again (the third portion 20 of the rear exhaust pipe Er) becomes sharp, causing another problem that the exhaust gas flow rate at that particular portion is reduced. Thus, the inclination can be set to about 90 degrees in the event that the diameter of the exhaust pipe is sufficiently great or the reduction in flow rate of exhaust gases constitutes no problem.

Note that with the exhaust pipe which is not flexed again after it has been routed downwardly (the front exhaust pipe Ef), since the thermal expansion of a component expanding in a direction toward the common collecting exhaust pipe 22 is great, the magnitude of the force for deviating the exhaust pipes along the mating faces does not change much even if the inclination of the mating faces 15*f*, 20*f* is changed.

Furthermore, while a force generated by vibrations of the exhaust pipes and the force generated by the thermal expansion of the two exhaust pipes to deviate the exhaust pipes along the mating faces 15*f*, 20*f* are caused to act on the connecting portion of the end portions (the end portion of the second portion of the front exhaust pipe Ef and the end portion of the third portion of the rear exhaust pipe Er) of the collecting portion side of the front and rear exhaust pipes Ef, Er with the common collecting exhaust pipe 22, the force acting on the connecting portion to deviate the exhaust pipes can be reduced by fittingly providing the ring member 24 on the outer circumference of the end portions on the collecting portion side of the front and rear exhaust pipes Ef, Er upstream of the connecting portion of the end portions on the collecting portion side of the front and rear exhaust pipes Ef, Er and the common collecting exhaust pipe 22 for integrally holding the end portions on the collecting portion side thereof, whereby the strength and durability at the connecting portion can be improved.

Moreover, in a case where the ring member 24 is fitted on the outer circumference of the end portions on the collecting portion side of the two exhaust pipes Ef, Er, stress generated at the end portions on the collecting portion side of the two exhaust pipes and the ring member 24 by the vibration of the exhaust pipes and the force generated by thermal expansion of the exhaust pipes to deviate the exhaust pipes along the mating faces becomes highest at the portion where the extensions of the mating faces intersect with the ring member 24.

On the other hand, in a case where the ring member 24 is fitted on the outer circumference of the end portions on the collecting portion side of the two exhaust pipes Ef, Er and thereafter is fixed thereto, although means is taken for welding the ring member 24 and the outer circumference of the end portions together or for shrink fitting the ring member 24 on the outer circumference of the end portions, when welding is used for fixing them, in the event that the ring member 24 and the outer circumference of the end portions are welded together around the full circumference thereof, the stress generated at the end portions of the two exhaust pipes and the ring member 24 becomes higher at the portion where the extensions of the mating faces 15*f*, 20*f* intersect with the ring member 24, the strength and durability of the two exhaust pipes Ef, Er and the ring member 24 are reduced by an extent to which the stress is further increased. In this case, as in the case with the previous embodiment, in the event that the outer circumference of the end portions on the collecting portion side of the two exhaust pipes Ef, Er and the ring member 24 are welded together at portions of the portion where the ring member 24 fits on the two exhaust pipes Ef, Er which do not intersect with the extensions of the mating faces 15*f*, 20*f*, the ring member 24 is allowed to slightly deform at the portion which intersects with the extensions of the mating faces 15*f*, 20*f*, as a result of which a slight degree of strain is permitted even at the end portions on the collecting portion side of the two exhaust pipes. Therefore, it is possible to alleviate the increase in stress at the end portions on the collecting portion side of the two exhaust pipes Ef, Er and the ring member 24 at the portions where the extensions of the mating faces 15*f*, 20*f* intersect with the ring member 24, there by making it possible to suppress the reduction in strength and durability of the two exhaust pipes Ef, Er and the ring member 24 when the ring member 24 and the outer circumference of the end portions on the collecting portion side of the two exhaust pipes Ef, Er are welded together.

Thus, while the embodiment of the invention has been described heretofore, the invention is not limited to the embodiment so described, and various types of embodiments are possible within the spirit and scope of the invention. For example, while of the front and rear exhaust pipes which are routed to below the engine, the rear exhaust pipe is flexed twice, the front exhaust pipe or both the front and rear exhaust pipes may be so flexed. In addition, in the embodiment while the exhaust system according to the invention is described as being applied to the V-type engine, the exhaust system may also be applied to a horizontal opposed engine.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

Thus, according to the first aspect of the invention, exhaust gas flows from the front exhaust pipe and the rear exhaust pipe can get confluent at the collecting portion in the same flowing direction, whereby the interference of exhaust gas flows can be reduced remarkably when compared with the conventional exhaust system, thereby making it possible to reduce the generation of interference noise by the interference of exhaust gas flows, and to avoid the occurrence of engine output reduction.

In addition, according to the second aspect of the invention, the effect provided by the first aspect of the invention can be provided, and on top of that, it is possible to reduce the likelihood that the thermal expansion of the exhaust pipes acts as the force to deviate the exhaust pipes along the mating surfaces thereof, thereby making it possible to improve the fastening force of the collecting portion and the strength of the constituent components of the collecting portion.

Furthermore, according to the third aspect of the invention, the same effect as that provided by the first aspect or second aspect can be provided, and on top of that, it is possible to reduce the force acting on the connecting portion of the end portions on the collecting portion side of the front and rear exhaust pipes with the common collecting exhaust pipe to deviate the two exhaust pipes from each other along the mating faces, as a result of which the strength and durability of the connecting portion can be improved.

Moreover, according to the fourth aspect of the invention, the same effect provided by the third aspect of the invention can be provided, and on top of that, it is possible to suppress the increase in stress at the end portions of the two exhaust pipes and the ring member at the portions where the extensions of the mating faces of the front and rear exhaust pipes intersect with the ring member, thereby making it possible to suppress the reduction in strength and durability of the exhaust pipes and the ring member when the ring member and the outer circumference of end portions of the exhaust pipes are welded together.

What is claimed is:

1. A vehicle engine exhaust system where in a pair of front and rear cylinder banks of an engine a crank shaft of which extends in a transverse direction of a vehicle body are disposed in a longitudinal direction of the vehicle body, comprising:

a front exhaust pipe connected to a front exhaust port of said front cylinder bank via a front exhaust manifold;

a rear exhaust pipe connected to a rear exhaust port of said rear cylinder bank via a rear exhaust manifold; and a common collecting exhaust pipe connected to both of said front and rear exhaust pipes at a collecting portion substantially disposed below the engine, wherein end portions of said front and rear exhaust pipes which are located closer to the collecting portion are arranged side by side in the same direction so as to be connected to said common collecting exhaust pipe, whereby exhaust gases flowing through said front and rear exhaust pipes are allowed to flow into said common collecting exhaust pipe in the same direction, wherein said front exhaust pipe and said rear exhaust pipe extend downwardly from said exhaust manifolds respectively, wherein said front exhaust pipe and said rear exhaust pipe are routed to below said engine by flexing said front exhaust pipe rearward of said engine and said rear exhaust pipe forward of said engine, and then at least one of said front exhaust pipe and said rear exhaust pipe is flexed again so that said ends on the collecting portion side of said two exhaust pipes are arranged side by side in the same direction so as to be connected to said common collecting exhaust pipe, wherein mating faces are respectively formed on said end portions of said front and rear exhaust pipes which are located closer to the collecting portion, and said mating faces are confronted from each other, and, wherein said mating faces are inclined relative to a plane passing through centers of said front and rear exhaust pipes.

2. The vehicle engine exhaust system as set forth in claim 1, wherein said mating faces are inclined by an angle of about 45 degree.

3. The vehicle engine exhaust system according to claim 1, further comprising:

a ring member integrally holding said end portions of said front and rear exhaust pipes, wherein said ring member is disposed upstream of said connecting portion defined by said end portions of said front and rear exhaust pipes and said common collecting exhaust pipe.

4. The vehicle engine exhaust system as set forth in claim 3, wherein the outer circumferences of said end portions of said front and rear exhaust pipes and said ring member are welded together at portions of a fitting portion where said ring member fits on said front and rear exhaust pipes which do not intersect with extensions of said mating faces of said front and rear exhaust pipes.

5. The vehicle engine exhaust system according to claim 2, further comprising:

a ring member integrally holding said end portions of said front and rear exhaust pipes, wherein said ring member is disposed upstream of said connecting portion defined by said end portions of said front and rear exhaust pipes and said common collecting exhaust pipe.

6. The vehicle engine exhaust system as set forth in claim 5, wherein the outer circumferences of said end portions of said front and rear exhaust pipes and said ring member are welded together at portions of a fitting portion where said ring member fits on said front and rear exhaust pipes which do not intersect with extensions of said mating faces of said front and rear exhaust pipes.

7. A vehicle engine exhaust system where in a pair of front and rear cylinder banks of an engine a crank shaft of which extends in a lateral direction of a vehicle body are disposed in a longitudinal direction of the vehicle body, comprising:

a front exhaust pipe connected to a front exhaust port of said front cylinder bank via a front exhaust manifold;

a rear exhaust pipe connected to a rear exhaust port of said rear cylinder bank via a rear exhaust manifold;

a common collecting exhaust pipe connected to both of said front and rear exhaust pipes at a collecting portion substantially disposed below the engine; and a ring member integrally holding end portions of said front and rear exhaust pipes, wherein said end portions of said front and rear exhaust pipes which are located closer to the collecting portion are arranged side by side in the same direction so as to be connected to said common collecting exhaust pipe, whereby exhaust gases flowing through said front and rear exhaust pipes are allowed to flow into said common collecting exhaust pipe in the same direction, wherein said end portions of said front and rear exhaust pipes which are located closer to the collecting portion are formed to have a cross section of a semi-circular shape respectively, and wherein said ring member is disposed upstream of said connecting portion defined by said end portions of said front and rear exhaust pipes and said common collecting exhaust pipe.

8. The vehicle engine exhaust system as set forth in claim 7, wherein the outer circumferences of said end portions of said front and rear exhaust pipes and said ring member are welded together at portions of a fitting portion where said ring member fits on said front and rear exhaust pipes which do not intersect with extensions of said mating faces of said front and rear exhaust pipes.

* * * * *